US005489034A

United States Patent [19]

Netto

[11] Patent Number: 5,489,034

[45] Date of Patent: Feb. 6, 1996

[54] SECURITY SEAL FOR SEALING THE END OF A TUBULAR MEMBER

[76] Inventor: Eduardo D. C. Netto, Rua SãLuis Gonzagn No. 912, Rio de Janeiro, Brazil

[21] Appl. No.: 311,852

[22] Filed: Sep. 26, 1994

[51] Int. Cl.[6] ..... B65D 55/06

[52] U.S. Cl. ..... 215/212; 215/280; 215/358

[58] Field of Search ..... 217/108, 110, 217/111; 220/DIG. 17; 215/212, 358, 361, 250, 253, 254, 280

[56] References Cited

U.S. PATENT DOCUMENTS

| | | | |
|---|---|---|---|
| 4,066,180 | 1/1978 | Sanchez | 215/254 |
| 4,759,455 | 7/1988 | Wilson | 215/206 |
| 4,826,029 | 5/1989 | Skoglie | 215/355 X |
| 4,871,077 | 10/1989 | Ogden et al. | 215/355 X |

FOREIGN PATENT DOCUMENTS

| | | |
|---|---|---|
| 662512 | 10/1965 | Belgium . |
| 1265008 | 3/1972 | United Kingdom . |

*Primary Examiner*—Allan N. Shoap

*Assistant Examiner*—Robin A. Hylton

*Attorney, Agent, or Firm*—Beveridge, DeGrandi, Weilacher & Young

[57] ABSTRACT

A one-piece injection molded tamperproof security seal is used for sealing the ends of tubular members, such as are found in some types of electricity meters. The seal is compact, it may be applied where there is limited space, and it has a high degree of inviolability. The seal comprises a plug adapted to be received in the tubular end, blocking means on the plug adapted for cooperation with engagement means on the tubular member, first locking means on the plug, and a closure portion which is hingeably attached to the plug and provided with second locking means. The seal has an open configuration in which the closure portion is remote from the plug portion and a sealed configuration in which the closure portion is folded over the plug with the first and second locking means in mutual locking cooperation. In the sealed configuration, the plug is within the end of the tubular member to be sealed, and displacement means on the closure portion cooperate with the plug to displace the blocking means from an unblocked configuration to a blocked configuration at which the blocking means cooperates with the engagement means on the tubular member.

14 Claims, 5 Drawing Sheets

FIG. 3
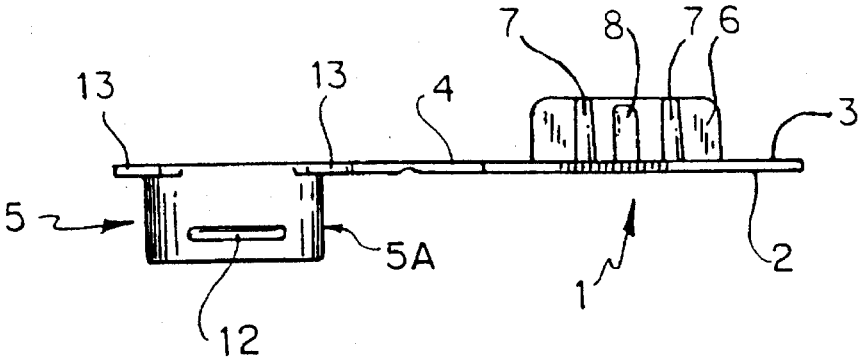
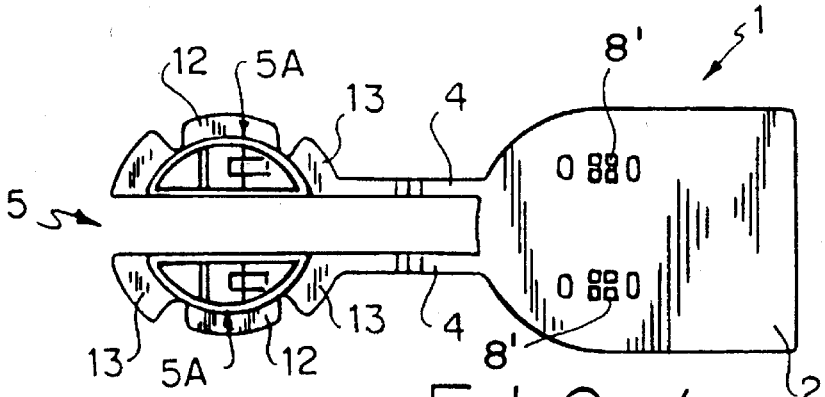
FIG. 4
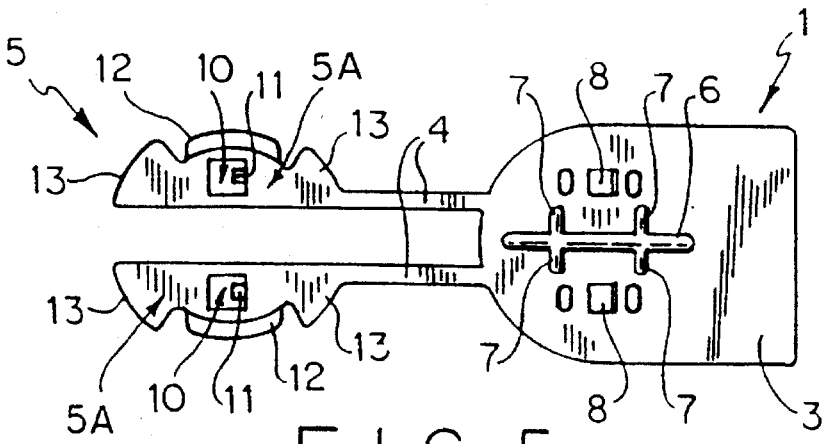
FIG. 5

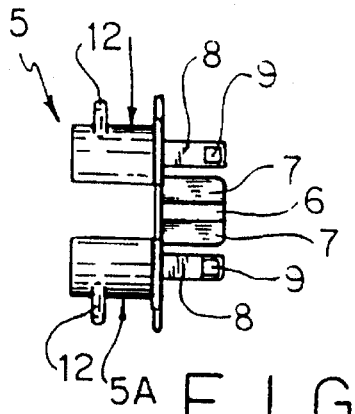
FIG. 6
FIG. 10
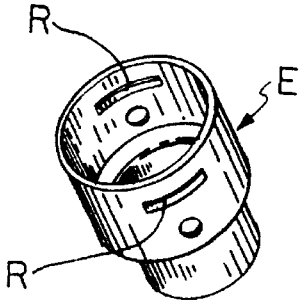
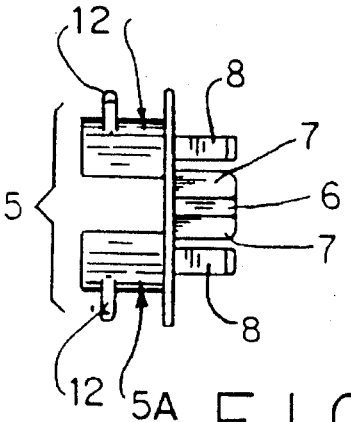
FIG. 7
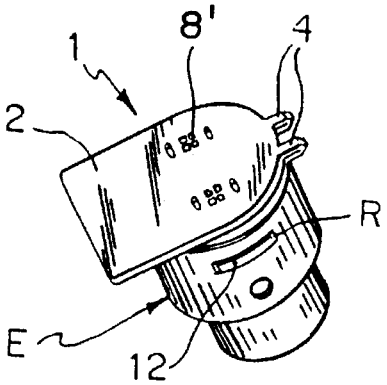
FIG. 11
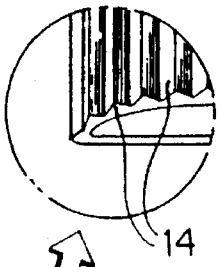
FIG. 9
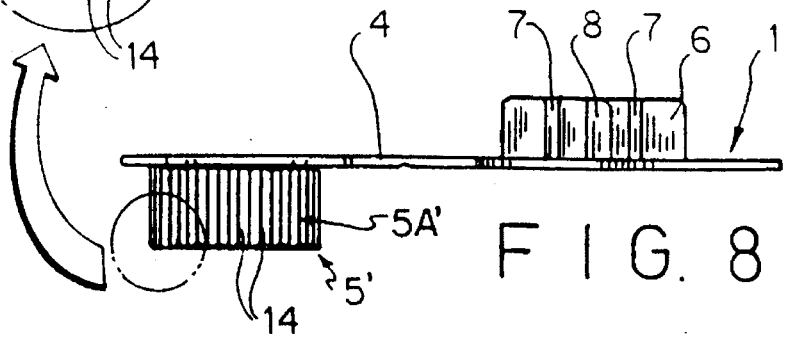
FIG. 8

FIG. 12
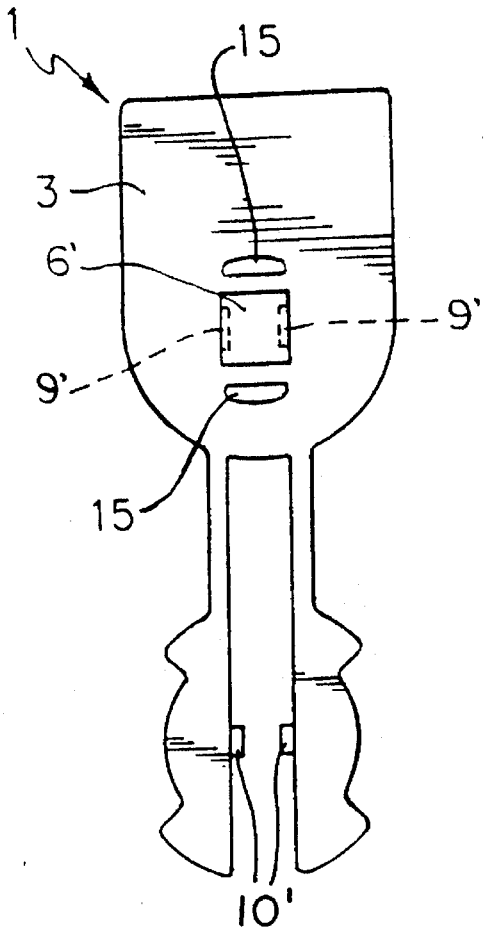
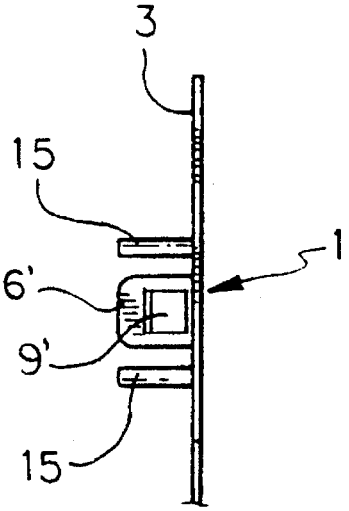
FIG. 14
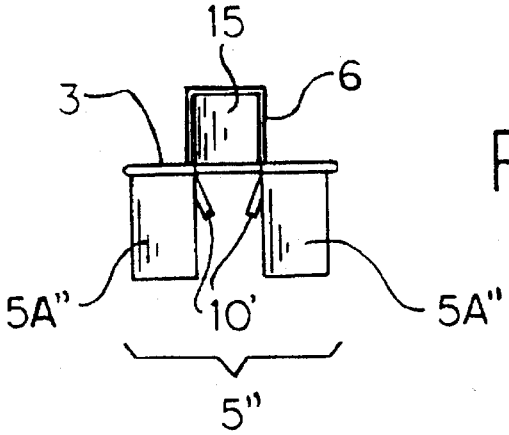
FIG. 13

SECURITY SEAL FOR SEALING THE END OF A TUBULAR MEMBER

BACKGROUND OF THE INVENTION

1. Field of the Invention

The present invention refers to a one piece security seal for inviolable sealing of the end of a tubular member of the type that comprises, adjacent the edge of such end, means for receiving locking elements, such as slits in its side wall or even internal ribs, disposed in a plane substantially parallel to the plane of the opening at the end to be sealed.

2. Description of the Prior Art

Applicant's PCT application published under WO 93/19995 on Oct. 14, 1993, (corresponding to Brazilian patent application PI 92001127, filed on Mar. 31, 1992, and which is incorporated herein by way of reference, discloses a one piece security seal for sealing the end of a tubular member of the above type. Such seal is shaped as a cover seal placeable so as to embrace the end to be sealed of the tubular member which has, adjacent its edge, a pair of diametrically opposite openings. The cover seal has a top panel and a cylindrical skirt split diametrically in two halves hinged to each other along a vertical line at the division between the two halves of the skirt, an inner protuberance in each said half fitting into one of the diametrically opposite openings in the tubular member, so that the cover seal can be closed by means of a hinge movement around the end of the tubular member and that, in the closed position, its axial movement is prevented by the interlocking engagement of a male locking element with a female locking element, respectively provided on the two halves of the cover seal.

Although it inviolably seals the end of the tubular member, the seal of the prior art patent application has a feature that, in certain applications, may limit its use, that is to say, the fact that the seal embraces (from the outside) the end of the tubular member, makes its application difficult and sometimes impossible when there is little space available around the end of the tubular member. For example, when the latter is closely adjacent a wall or any other object, it is impossible to place the seal over and around the end of the tubular member.

An example of a tubular member of the type mentioned herein is an electricity meter commonly used in the United States of America.

OBJECT OF THE INVENTION

It is therefore an object of the present invention to provide a seal that may be installed totally within the end of the tubular member, without the need for space in the outer region immediately adjacent such end, and that provides a tamper-proof seal for that end.

SUMMARY OF THE INVENTION

This object is attained in accordance with the present invention by a one piece security seal which has an open configuration and a sealed configuration. A plug portion is adapted to be received in the end of a tubular member, and, blocking means on the plug portion are adapted for cooperation with engagement means in the side wall of the tubular member. A closure portion is hingeably attached to the plug portion and is provided with first locking means. Second locking means are provided on the plug portion. In the open configuration, the closure portion is remote from the plug portion. In the sealed configuration, the closure portion is folded over the plug portion, and the first and second locking means are in mutual locking cooperation, whereby return from the sealed configuration to the open configuration is not possible without destroying the security seal which is thus rendered tamperproof. The closure portion has displacement means which, in response to movement of the seal from its open configuration to its sealed configuration, displaces the blocking means of the plug portion from an unblocked configuration to a blocked configuration at which the blocking means cooperates with the engagement means in the side wall of the tubular member.

In another respect, the invention involves a one-piece security seal which has a closure portion and a plug portion. The closure portion includes a pair of locking teeth, and a wedge portion which is located between the locking teeth. The plug portion includes a pair of independent plug halves, each of which has a locking formation for locking cooperation with a respective one of the locking teeth. A pair of flexible arms independently connect the plug halves to the closure portion. Each plug half is formed externally with a blocking portion cooperable with a respective engagement means in the side wall of the tubular member. In use, the plug portion is inserted into the end of the tubular member with the plug halves relatively adjacent to each other. The closure portion is folded over the plug halves about the flexible arms so that the wedge portion enters between the plug halves and forces them into a relatively separated position in which the locking teeth cooperate with the locking formations, whereby return of the plug halves from their relatively separated position is not possible without destroying the security seal which is thus rendered tamperproof.

Preferably, the plug portion comprises two halves expandable from a position in which they are relatively adjacent each other to a second position in which they are relatively separated from each other and said displacement means comprise a wedge on the closure portion positioned to enter between and separate said two halves as the seal passes from the open configuration to the sealed configuration.

The blocking means may suitably comprise an outer protuberance on each of the halves of the plug portion and the engagement means may be a pair of openings in the wall of the tubular member, such openings being adapted to receive the protuberances in the sealed configuration.

In another aspect, the invention relates to a one piece security seal for sealing the end of a tubular member provided with a pair of engagement means in its side wall, the seal comprising: a closure portion provided with a pair of locking teeth and, between the locking teeth, a wedge portion; a plug portion comprising a pair of independent plug halves, each plug half having a locking formation for locking cooperation with a respective one of the locking teeth; a pair of flexible arms independently connecting the plug halves to the closure portion; each plug half being formed externally with a blocking portion cooperable with a respective one of the engagement means when the plug portion is inserted into the end of the tubular member with the plug halves relatively adjacent to each other and the closure portion is folded over the plug halves about the flexible arms so that the wedge portion enters between the plug halves and forces them into a relatively separated position in which the locking teeth cooperate with the locking formations.

In order to facilitate authorized opening of the device being sealed (i.e. authorized breakage of the seal), each locking tooth may be joined to the closure portion by a weakening. In a preferred embodiment, the locking teeth are formed on a tearaway strip of the closure portion.

BRIEF DESCRIPTION OF THE DRAWINGS

The present invention will now be described in greater detail, but only by way of example, with reference to four preferred embodiments illustrated in the accompanying drawings, in which:

FIG. 3 is side elevation of the seal of FIGS. 1 and 2, the opposite side being identical;

FIG. 4 is a plan view of the seal, corresponding to the side shown in FIG. 1;

FIG. 5 is a plan view, similar to that of FIG. 4, but corresponding to the side of the seal seen in FIG. 2;

FIG. 6 is an end elevation of the seal, seen from the left side of FIG. 4;

FIG. 7 is an end elevation of the seal, seen from the right side of FIG. 4;

FIG. 8 is side elevation of a seal according to a second embodiment of the invention;

FIG. 9 is an enlarged view of the detail indicated in FIG. 8;

FIG. 10 is a perspective view of the end of a tubular member to be sealed by a seal according to the present invention;

FIG. 11 is a perspective view of the end of the tubular member of FIG. 10, sealed by the seal shown in FIGS. 1 to 7;

FIG. 12 is a plan view of a security seal according to a third embodiment of the present invention, similar to that of FIG. 5, but illustrating an alternative form of fitment/locking means;

FIG. 13 is a top view, similar to that of FIG. 7, of the seal of FIG. 12;

FIG. 14 is a partial side elevation of the seal of FIG. 12, showing only the portion corresponding to the seal closure plate;

DESCRIPTION OF THE PREFERRED EMBODIMENTS

Figure 1:
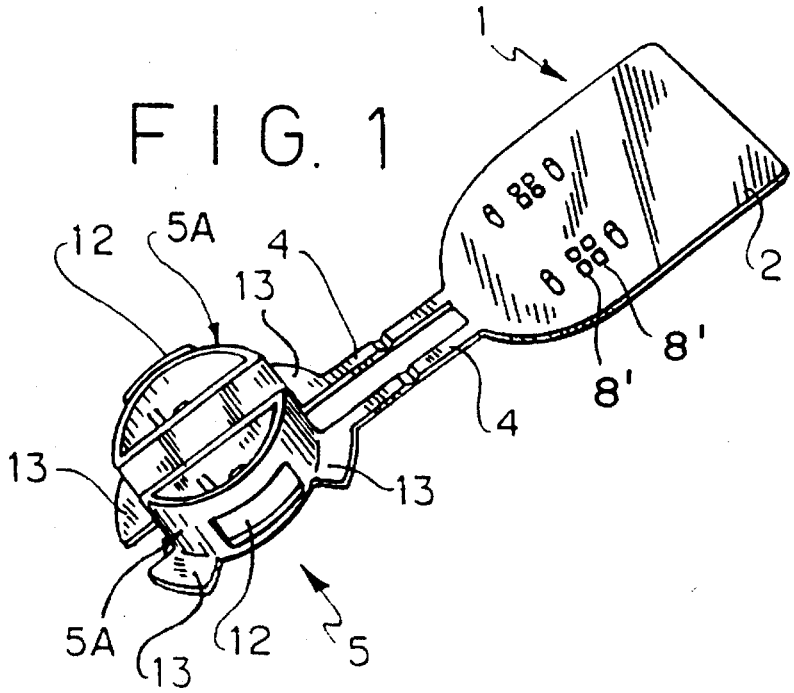
FIG. 1 is a perspective view of a first side of a security seal according to a first preferred embodiment of the invention, in its open position.
Figure 2:
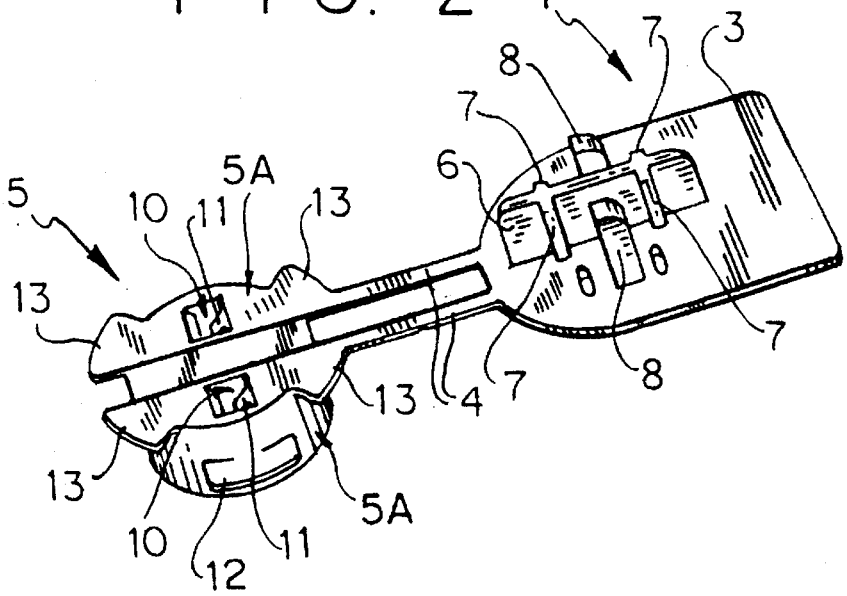
FIG. 2 is a perspective view, similar to that of FIG. 1, but showing the opposite side of the same security seal.

As can be seen from FIGS. 1 to 7, a plastic injection molded one piece security seal according to a first embodiment of the present invention comprises a closure plate 1 having an outer or top surface 2 visible in FIGS. 1 and 4, an inner or bottom surface 3 visible in FIGS. 2 and 5, and two flexible arms 4 extending from one edge of the closure plate 1. At the end of each flexible arm 4 there is one half 5A of a plug element 5 designed to be introduced into the interior of an end E of a tubular member (FIGS. 10 and 11) to be sealed, as will be explained later.

The inner surface 3 of closure plate 1 is provided centrally, along its length, with a wedge member 6 in the form of a wall provided with separator ribs 7 on both sides. Inner surface 3 of closure plate 1 is also provided, on both sides of wedge member 6, with a pair of locking teeth 8 (locking means) in the form of protuberances extending normally from surface 3 and having recesses 9 in their side walls that face the flexible arms 4 in the open configuration of the seal.

Plug element 5, in this embodiment formed by the two halves 5A that are respectively connected to the flexible arms 4, is formed internally of each half 5A with a pair of second locking means 10, each in the form of a cavity having a small protuberance 11 therein that cooperates with the corresponding locking tooth 8 on the inner surface 3 of closure plate 1, as will be described below.

The small protuberances 11 and the recesses 9 are so shaped that, on introducing the locking teeth 8 into the cavities 10, the small protuberances 11 enter the recesses 9 and make it impossible to remove locking teeth 8 from cavities 10 without destroying the teeth or the protuberances.

Each of the halves 5A of the plug element 5 also has an outer rib 12, extending normally from its outer wall and designed for fitting into slot openings R formed in the wall of end E of the tubular element to be sealed (see FIG. 10 and 11). Each half 5A also has an outer end circumferential flange 13 for resting on the end edge of the tubular member in the sealed configuration.

The application of the seal of the first embodiment of the invention with a view to sealing the end E of a tubular member will now be described. Firstly, flexible arms 4 are flexed inwardly so that halves 5A of plug element 5 close against each other. The plug element 5 is then, in such configuration, inserted into the end E of the tubular member. As soon as outer ribs 12 register with slot openings R in the tubular member and pressure is released from arms 4, the latter together with halves 5A expand to their original configuration and ribs 12 enter slot openings R, axially locking the plug element 5 in the inserted position.

Closure plate 1 is then folded over plug element 5, flexible arms 4 acting as a hinge, and teeth 8 enter cavities 10 until the small protuberances of the latter click into the small recesses 9 in the teeth, thus locking the seal in the closed or sealed configuration shown in FIG. 11.

It is important to note that, as closure plate 1 is folded over, wedge member 6 forces its way between halves 5A of plug member 5 and separator plates 7 then expand halves 5A to maintain the plug tightly inside the end E of the tubular member with outer ribs 12 thus positively blocked in slot openings R. Consequently, once the seal has been closed, it is impossible to remove it since the cooperation between the outer ribs 12 and the slot openings R prevent any axial movement of the seal, whereas opening of the seal itself is prevented by the cooperation between locking teeth 8 and small protuberances 11.

It will also be noted from FIGS. 1, 4 and 11 of the drawings that the bases of teeth 8 have breakable connections weakened at 8' so that, when access to the end E of the tubular member is authorized (for example when an authorized employee of the electricity company has to gain access to the electricity meter being protected by the seal), closure plate 1 may be forcibly lifted until pins 8 break off at their bases weakened at 8'. As closure plate 1 is lifted, wedge 6 leaves the interior of plug element 5 and permits the latter to be removed simply.

FIGS. 8 and 9 illustrate a second embodiment of the invention in which a plug element 5', instead of outer ribs 12, is formed with axial splines 14 of deformable material along the outer wall of each half 5A. This embodiment of the invention may be used for sealing the ends of tubular member having internal ribs or protuberances in planes substantially parallel to the plane of the end edge, that is to say, perpendicular to splines 14.

On applying such a seal basically as described above, axial splines 14 are forced against the internal ribs (not shown) in the end of the tubular member and are thus deformed so as to provide a means for positively preventing the removal of the seal.

Referring now to FIGS. 12, 13 and 14, a seal according to a third embodiment of the invention has first locking means situated on the inner surface 3 of a closure plate 1, in the form of two lateral recesses 9', one on each outer side of a centrally arranged wedge member 6'. There are also two wall sections 15 adjacent and parallel, respectively, to the other two sides of the wedge member 6'.

Similarly to the seals of FIGS. 1 to 9, the plug element 5" of the seal of FIGS. 12 to 14 is split into two halves 5A". Each half 5A" is similar to halves 5A and 5A' of the previously described embodiments, but they have locking means on their inner side walls in the form of two flexible projections 10' that cooperate with the lateral recesses 9' in wedge member 6'.

Consequently, when the closure plate 1 is folded over plug element 5", in a manner similar to that described above, wedge member 6' forces halves 5A" of plug element 5" against the inner walls of the end E of the tubular member being sealed at the same time that the flexible projections 10' penetrate recesses 9' to lock the seal closed.

Wall sections 15 serve, in the sealed configuration, to prevent access to the region of the locking means (recesses 9' and flexible projections 10', thus improving the degree of security offered by the seal.

It will naturally be understood that FIGS. 12 to 14 do not show the outer ribs 12 or the axial splines 14 or any equivalent means for locking the closed seal within end E of the tubular member being sealed. This is merely for the purpose of simplifying the visualization of the embodiment, it being obvious that such locking means will also be provided in this case.

Figure 15:
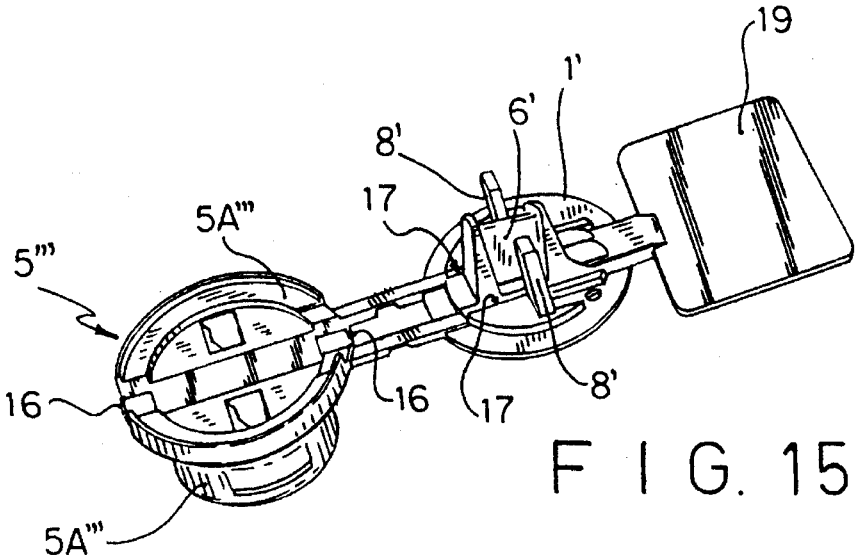
FIG. 15 is a perspective view, similar to that of FIG. 2, of a seal according to a fourth preferred embodiment of the present invention.
Figure 16:
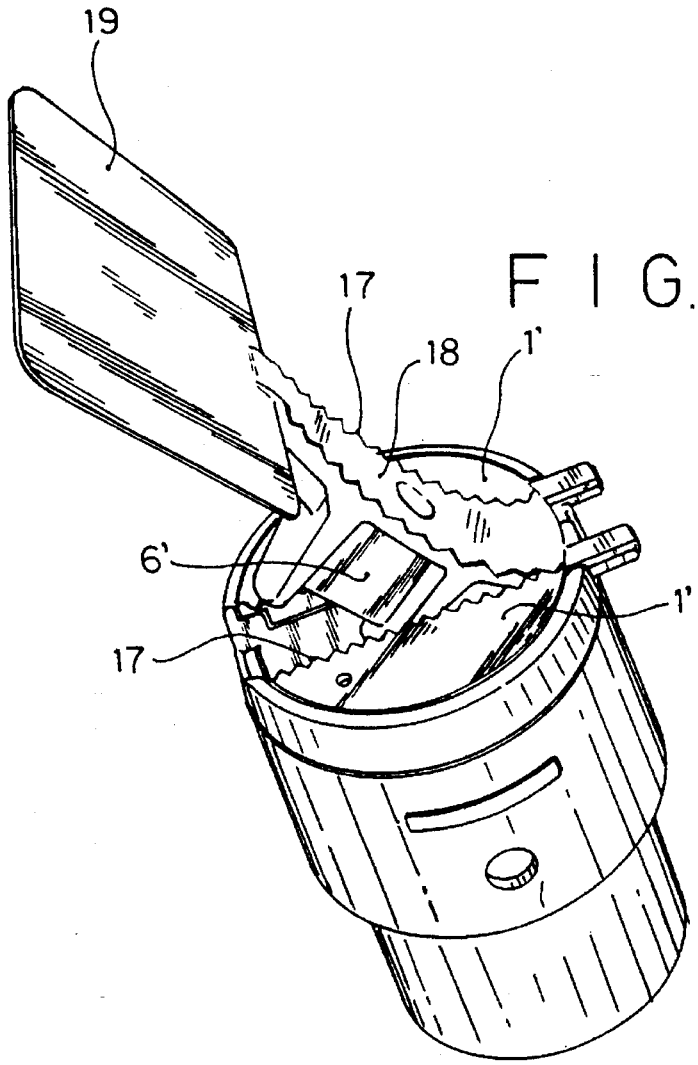
FIG. 16 is a perspective view of a tubular member sealed with the fourth embodiment seal which is in the process of being opened.

Finally, a fourth preferred embodiment is illustrated in FIGS. 15 and 16. The basic difference between this fourth embodiment and the first embodiment shown in FIGS. 1 to 11 is the manner in which authorized opening of the seal is facilitated and, moreover, unauthorized opening is more easily observed. In the case of the seal of FIGS. 15 and 16, the two halves 5A'" of the plug 5'" are joined together by a pair of peripheral flexible connections 16 to make the plug element more sturdy, the two halves 5A'" then pivoting about such connections to when the plug is inserted into the end E of the tubular member being sealed.

The locking teeth 8' of the fourth embodiment seal do not have individual weakened bases as in the case of the first embodiment. Instead, closure plate 1' is itself formed with a pair of parallel weakening lines 17 from one side to the other to define a tearaway strip 18 on which the wedge member 6' is formed. Locking teeth 8' are arranged on closure plate 1' externally (one on each side) of tearaway strip 18. One end of tearaway strip 18 extends outwardly from the rest of the seal in the form of a blade 19. When the seal is to be opened (see FIG. 16), the authorized person grips the blade 19 and pulls upwardly so the tearaway strip 18 is torn away from the rest of the seal, taking wedge member 6' with it. This permits both easy removal of the plug portion 5'" and destroys the closure plate 1' so that there is no possibility that a tampered seal can ever be replaced to avoid detection in a cursory inspection.

Finally it will be understood that the present invention has been described with respect to only four presently preferred embodiments given purely by way of example and that any modifications within the same inventive concept should be considered within the scope of the invention which should only be limited by the terms of the following claims.

I claim:

1. A one piece security seal for sealing the end of a tubular member the tubular member being provided with engagement means in the inner side wall thereof, said seal having an open configuration and a sealed configuration wherein said seal comprises:

a plug portion adapted to be received in the end of said tubular member;

blocking means on said plug portion adapted for cooperation with said engagement means on said tubular member;

a closure portion hingeably attached to said plug portion and provided with first locking means, second locking means on said plug portion, said closure portion being remote from said plug portion in said open configuration and said closure portion being folded over said plug portion with said first and second locking means in mutual locking cooperation to define said sealed configuration, whereby return from said sealed configuration to said open configuration is not possible without destroying said security seal which is thus rendered tamperproof;

said closure portion having displacement means which, in response to movement of said seal from its open configuration to its sealed configuration, displaces said blocking means of the plug portion from an unblocked configuration to a blocked configuration at which the blocking means cooperates with the engagement means on the tubular member.

2. A one-piece security seal according to claim 1, wherein said plug portion comprises two halves expandable from a position in which they are relatively adjacent each other to a second position in which they are relatively separated from each other and wherein said displacement means comprise a wedge on said closure portion positioned to enter between and separate said two halves as said seal passes from said open configuration to said sealed configuration.

3. A one-piece security seal according to claim 2 for use with a tubular member in which said engagement means includes a pair of openings in the inner side wall thereof, wherein said blocking means comprise an outer protuberance on each of said halves of said plug portion said protuberances being adapted, in use, to be received in said openings of a tubular member.

4. A one-piece security seal according to claim 3, wherein said first locking means comprises locking teeth.

5. A one-piece security seal according to claim 4, wherein said two halves of said plug portion are connected to said closure portion by two respective flexible arms defining a hinge between said plug portion and said closure portion.

6. A one-piece security seal according to claim 4, wherein said locking teeth are attached means to said closure portion by a breakable weakened connection.

7. A one-piece security seal according to claim 6, wherein said two halves of said plug portion are connected to said closure portion by two respective flexible arms defining a hinge between said plug portion and said closure portion.

8. A one-piece security seal according to claim 4, wherein said wedge is formed on a tearaway strip of said closure portion.

9. A one-piece security seal according to claim 8, wherein said closure portion is a closure plate adapted to cover transversally the said end of said tubular member to be sealed.

10. A one-piece security seal for sealing the end of a tubular member provided with a pair of engagement means in the inner side wall thereof, wherein said seal comprises:

a closure portion provided with a pair of locking teeth and, between said locking teeth, a wedge portion;

a plug portion comprising a pair of independent plug halves, each said plug half having a locking formation for locking cooperation with a respective one of said locking teeth;

a pair of flexible arms independently connecting said plug halves to said closure portion;

each said plug half being formed externally with a blocking portion cooperable with a respective one of said engagement means when, in use, said plug portion is inserted into said end of said tubular member with said plug halves relatively adjacent to each other and said closure portion is folded over said plug halves about said flexible arms so that said wedge portion enters between said plug halves and forces them into a relatively separated position in which said locking teeth cooperate with said locking formations, whereby return from said relatively separated position is not possible without destroying said security seal which is thus rendered tamperproof.

11. A one-piece security seal according to claim 10, wherein said locking teeth are joined to said closure portion a breakable weakened connection.

12. A one-piece security seal according to claim 10, wherein said wedge portion is formed on a tearaway strip of said closure portion.

13. A one-piece security seal according to claim 10, wherein said closure portion is a closure plate adapted to cover transversally the said end of said tubular member to be sealed.

14. A one-piece security seal according to claim 12, wherein said closure portion is a closure plate adapted to cover transversally the said end of said tubular member to be sealed.

* * * * *

UNITED STATES PATENT AND TRADEMARK OFFICE

CERTIFICATE OF CORRECTION

PATENT NO. : 5,489,034
DATED : February 6, 1996
INVENTOR(S) : Eduardo de Lima Castro Netto It is certified that error appears in the above-indentified patent and that said Letters Patent is hereby corrected as shown below:

On the title page, item [76] Inventor name should read:

--Eduardo de Lima Castro Netto--

The inventor's street address is changed to:

--Rua São Luiz Gonzaga, No. 912--

Signed and Sealed this

Twenty-third Day of July, 1996

*Attest:*

*Attesting Officer*

BRUCE LEHMAN

*Commissioner of Patents and Trademarks*